United States Patent [19]

Zitz et al.

[11] Patent Number: 4,613,256

[45] Date of Patent: Sep. 23, 1986

[54] SUPPORTING FRAME

[75] Inventors: Alfred Zitz, Zeltweg; Karl Lerchbaum, Fohnsdorf; Werner Toferer, Grosslobming; Heinrich Süssenbeck, Zeltweg, all of Austria

[73] Assignee: Voest-Alpine Aktiengesellschaft, Linz, Austria

[21] Appl. No.: 680,042

[22] Filed: Dec. 10, 1984

[30] Foreign Application Priority Data

Dec. 20, 1983 [AT] Austria ..... 4458/83

[51] Int. Cl.[4] ..... E21D 15/44

[52] U.S. Cl. ..... 405/299; 405/291; 405/302

[58] Field of Search ..... 405/291, 295, 296, 298, 405/299, 302

[56] References Cited

U.S. PATENT DOCUMENTS

| | | | |
|---|---|---|---|
| 2,657,028 | 10/1953 | Joy | 405/298 |
| 4,155,675 | 5/1979 | Friedrichs | 405/291 |
| 4,293,246 | 10/1981 | Boer et al. | 405/291 |
| 4,348,138 | 9/1982 | Blampain et al. | 405/298 X |

*Primary Examiner*—David H. Corbin

*Attorney, Agent, or Firm*—Cushman, Darby & Cushman

[57] ABSTRACT

The invention refers to a movable supporting frame for supporting the roof in underground cavities, in particular for securing the excavating edge when recovering the pillars in coal mining, comprising a cap (5) supported against a base frame (1) by means of hydraulically extendable props (3) and a lemniscate drive means (4), the props (3) being pivotally connected with the base frame (1) and with the cap (5). The props (3) are essentially perpendicularly oriented relative to stratification and are linked to the base frame (1) and to the cap (5) in a universally pivotably manner, noting that preferably four props are arranged at the corners of a rectangle as seen in a plan view. The lemniscate drive means (4) is connected with the base frame (1) for swivelling movement in transverse direction relative to the plane defined by the lemniscate guides (8, 9) and is adjustably supported against any swivelling movement and is connected with the cap (5) for universal swivelling movement. The cap (5) can be lowered into a transport position (5'') located below the lowest working position. One lemniscate guide (8) is pivotally linked to a length-adjustable directing strut (12) having its other end pivotally linked to a linking point (13) connected with the base frame (1), the length (b) of said directing strut being maintained unchanged within the operating range (a) of the supporting frame and being increased in transport position (5''). This allows to select a very low transport position without obstructing the operating positions defined by the lemniscate drive means (FIG. 1).

8 Claims, 6 Drawing Figures

Figure 1:
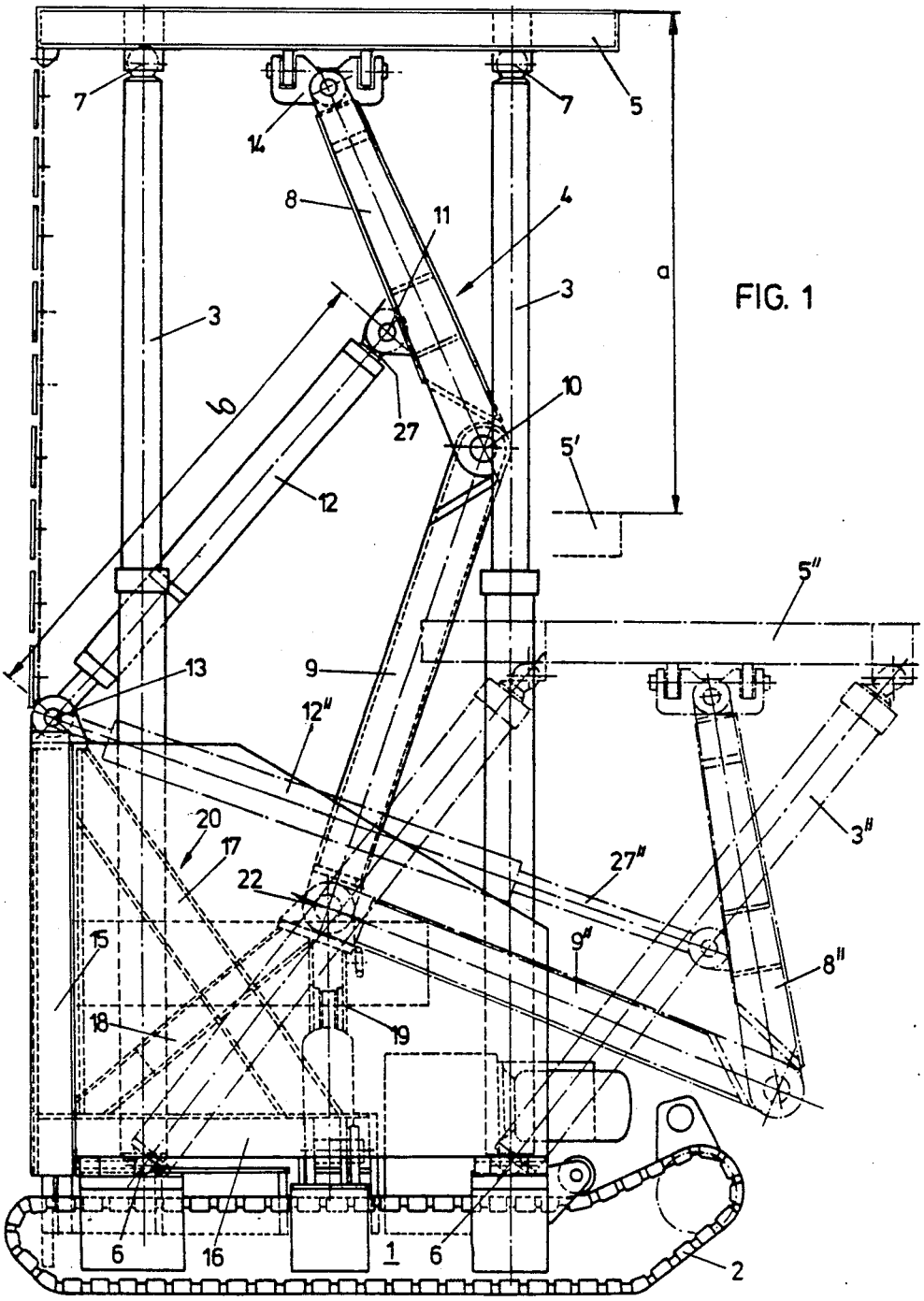

FIG. 4
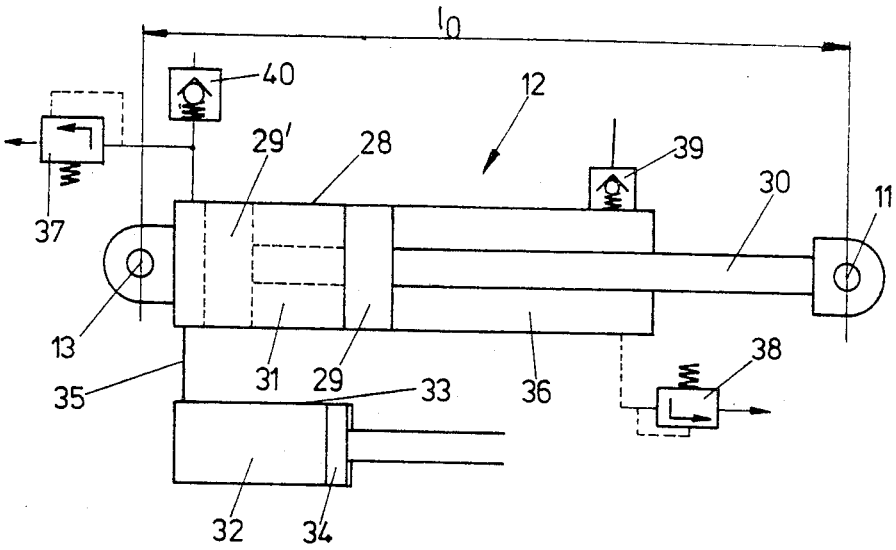
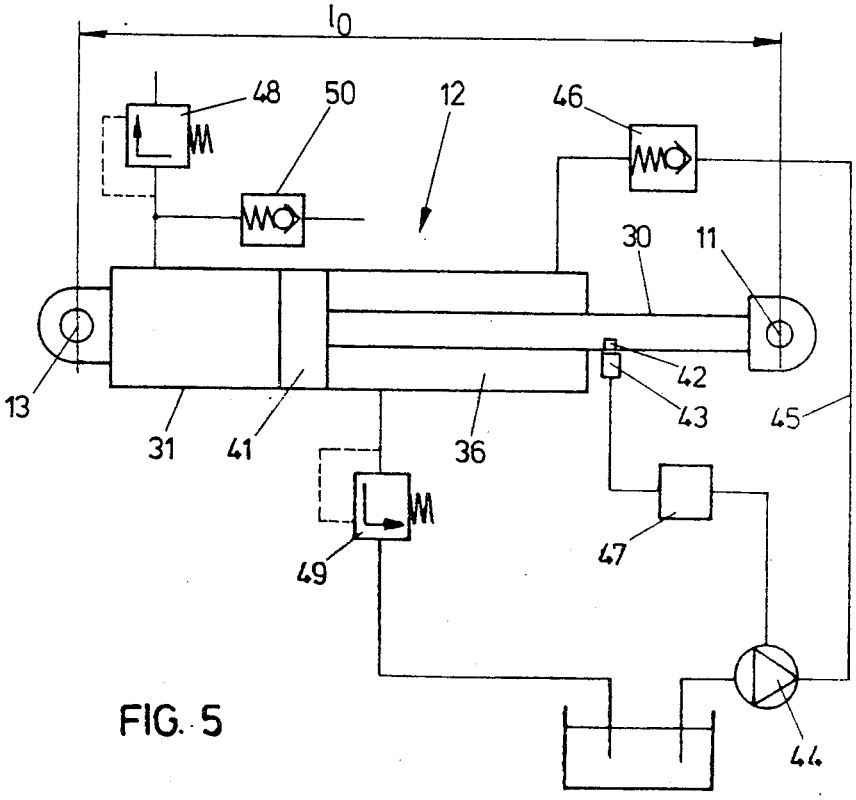
FIG. 5

SUPPORTING FRAME

The invention refers to a movable supporting frame for supporting the roof in underground cavities, in particular for securing the excavating edge when recovering the pillars in coal mining, comprising a cap supported against a base frame by means of hydraulically extendable props and a lemniscate drive means, the props being pivotally connected with the base frame and with the cap. It is known to support the cap of a supporting frame against the base frame by means of hydraulic props and by means of a lemniscate drive means, the lemniscate drive means having as an effect that the cap is guided during lifting movement in a substantially vertical direction. In this known arrangement, the props are inclined to assume a mutually oblique position, so that swivelling movement of the props under the influence of lateral forces is not or only restrictedly possible under load conditions in spite of the props being pivotably connected with the base frame and with the cap. Such pivotal connection of the props allows to change the angle when moving the cap in upward direction. However, if the cap is laterally shifted in its supporting position, one prop increases the distance between cap and base frame while the other prop reduces this distance. In addition, the known constructions can only be used in connection with low roof heights. In particular connection with the room- and -pillar process applied in coal mining, extremely great roof heights may occur for which the known supporting frames can not be used.

It is an object of the invention to provide a supporting frame which can be used also for great roof heights and which is capable to receive laterally acting forces also in case of great roof heights. The invention essentially consists in that the props assume essentially perpendicular position to stratification and are linked to the base frame and to the cap in a universally pivotable manner thereby preferably providing four props arranged—as seen in a plan view—at the gorners of a rectangle, in that the lemniscate drive means is connected with the base frame for swivelling movement in transverse direction relative to the plane defined by the lemniscate guides and is adjustably supported against any swivelling movement and is connected with the cap for universal swivelling movement, in that the cap can be lowered into a transport position located below the lowest working position and in that one lemniscate guide is pivotally linked to a length-adjustable directing strut having its other end pivotally linked to a linking point connected with the base frame, the length of said directing strut being maintained unchanged within the operating area of the supporting frame and being increased in transport position. On account of the props extending approximately perpendicular to stratification, it is possible to swivel the props under the action of load out of their perpendicular position without substantially changing the distance between the base frame and the cap, so that any shifting of the roof can be taken into consideration without changing the supporting force. This is of particular advantage for securing the excavating edge when recovering pillars. When arranging four props according to a rectangle, the cap is given the possibility to become shifted in all directions under the action of laterally acting forces. The lemniscate drive means provides the possiblity to guide the cap in vertical direction when applying the cap against the roof.

For the purpose of resisting any shifting movements of the roof in direction of the plane defined by the lemniscate guides, the lemniscate guides are supported by means of the directing strut. Any shifting movement of the cap in transverse direction relative to the plane defined by the lemniscate guides is taken into consideration by pivotably linking the lemniscate guides to the base frame for swivelling movement in transverse direction to the plane defined by these lemniscate guides, and the cap is supported against such shifting movements by adjustably supporting the lemniscate guides against swivelling movement in transverse direction defined by the lemniscate guides. Any overloading in transverse direction relative to the plane defined by the lemniscate guides can thus be avoided and the plane defined by the lemniscate guides can—in dependence on the condition of the roof—be brought in an oblique position by the adjustable support. On account of the cap being linked to the lemniscate guide means for universal swivelling movement, the cap can correctly contact the roof. On account of the length of the directing strut being maintained unchanged within the operating range of the supporting frame, there is provided the possibility to lift the cap in vertical direction without changing the length of the directing strut, and on account of the length of the supporting strut being extendable outside of the operating range of the supporting frame, there is provided the possibility to select a very low transport position of the cap.

According to a preferred embodiment of the invention, the directing strut is formed of a hydraulic piston-cylinder-aggregate comprising two working chambers and being maintained in a predetermined mean length-position within the working operating range of the supporting frame by means of the pressurized fluid contained in the working chambers both comprising over-load valves and being extendable for attaining the transport position. If the working chambers are filled with a predetermined amount of pressurizing fluid, the supporting frame can be lifted and lowered without the necessity of special care of the operator. The over-load valves avoid any over-load of the lemniscate drive means, in particular by laterally acting forces, in direction of the plane defined by the lemniscate guides, and such a piston-cylinder-aggregate provides the possibility to increase in a simple manner the length of this hydraulic directing strut for attaining a low transport position of the cap. This can be achieved in a simple manner if that working chamber of the hydraulic piston-cylinder-aggregate, which is located opposite the piston rod, is connected with the working chamber of the piston of a measuring cylinder. By transferring the pressurizing fluid from this storage cylinder into the working space of the cylinder-piston-aggregate forming the directing strut, a mean position of the cylinder-piston-aggregate forming the directing strut can be adjusted, in which position the cap is reliably guided in vertical direction. Such a mean position is not identical with the geometrical mean position of the piston within the piston-cylinder-aggregate, but is a position from which the piston of the cylinder-piston-aggregate forming the directing strut can start moving in both directions, so that the directing strut can yield in both directions in case of any over-load, noting that in this case pressurizing fluid emerges from the respective working chamber via an over-load valve. The volumetric capacity of the storage cylinder can be adjusted by means of the piston, so that a defined amount of pressurizing fluid, which amount results in the respective piston position, is introduced into the working chamber of the piston-cylinder-aggregate forming the directing strut. According to the invention the total volumetric capacity of the measuring cylinder is, however, preferably equal the volume of the working chamber of the piston-cylinder-aggregate located opposite the piston rod and this in the predetermined mean adjusted length-position of this aggregate, whereby adjustment of the mean position of the piston of the piston-cylinder-aggregate forming the directing strut is simplified.

According to a preferred embodiment of the invention, the arrangement is such that the lemniscate drive means is laterally stiff in the direction transversally extending relative to the plane defined by the lemniscate guides, that the lemniscate drive means is supported at both sides by piston-cylinder-aggregates in a direction transversally extending relative to the plane defined by the lemniscate guides and that the working chambers of these piston-cylinder aggregates can arbitrarily be supplied with pressurizing fluid and comprise over-load valves. Because such piston-cylinder-aggregates can provide high supporting forces and on account of the lateral stiffness, the lemniscate drive means can resist lateral forces acting in transverse direction relative to the plane defined by the lemniscate guides also in case of great roof heights. On account of arbitrarily supplying pressurizing fluid to the working chambers of these piston-cylinder-aggregates, the plane defined by the lemniscate guides can be adjusted in accordance with the desired requirements and on account of the over-load valves any excessive load is avoided which acts on the lemniscate drive means in said transverse direction. In this case and according to the invention, the arrangement is conveniently such that a swivel frame having linked thereto the lower lemniscate guide and the directing strut is linked to the base frame for swivelling movement in transverse direction relative to the plane defined by the lemniscate guides, that the swivel frame and the lemniscate guide are connected one with the other for being laterally stiff in transverse direction relative to the plane of the lemniscate guides and that the piston-cylinder-aggregates acting in transverse direction relative to the plane defined by the lemniscate guides are acting on the swivel frame. In this manner, a laterally stiff unit is provided and, because the directing strut is acting on the swivel frame, any lateral swivelling movement of the lemniscate drive means does not change the adjustment of the directing strut.

According to an advantageous embodiment of the invention, the base frame is movable on a crawler chassis and has a drive means for the caterpillars, and a remote control can be provided for the drive means of the caterpillars. In this manner, movement of the supporting frame from one operating area to the other is facilitated. If the supporting frame is used for securing the excavating edge in the room- and -pillar process, there exists the danger that the roof becomes partially collapsed after having recovered the pillars. The remote control provides the possibility to remove the operating personnel from the endangered area.

The supporting frame according to the invention can be operated in connection with very great roof heights. Such a supporting frame can be operated even if the roof height is, for example, 4 to 6.5 m, noting that the cap can, in transport position, be brought below the lowest working height.

In the drawing, the invention is schematically illustrated with reference to embodiments.

Figure 2:
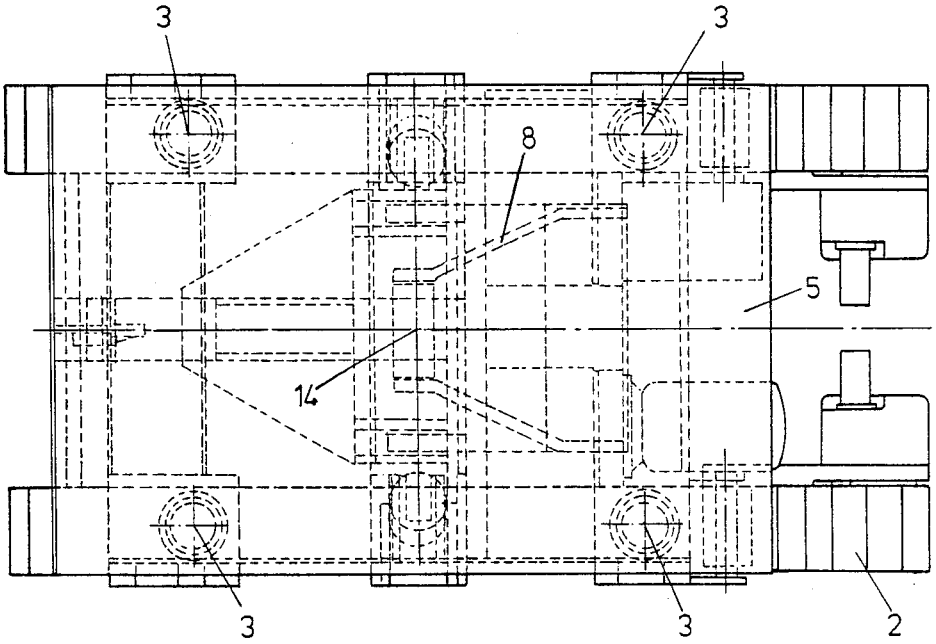
Figure 3:
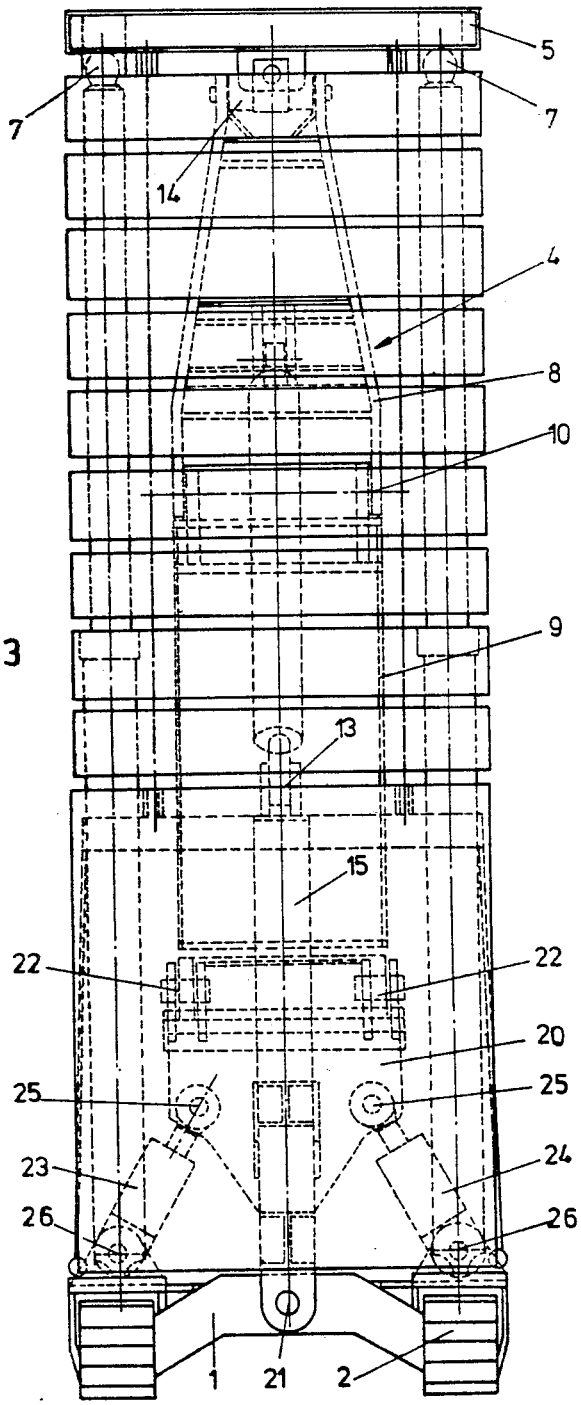
Figure 6:
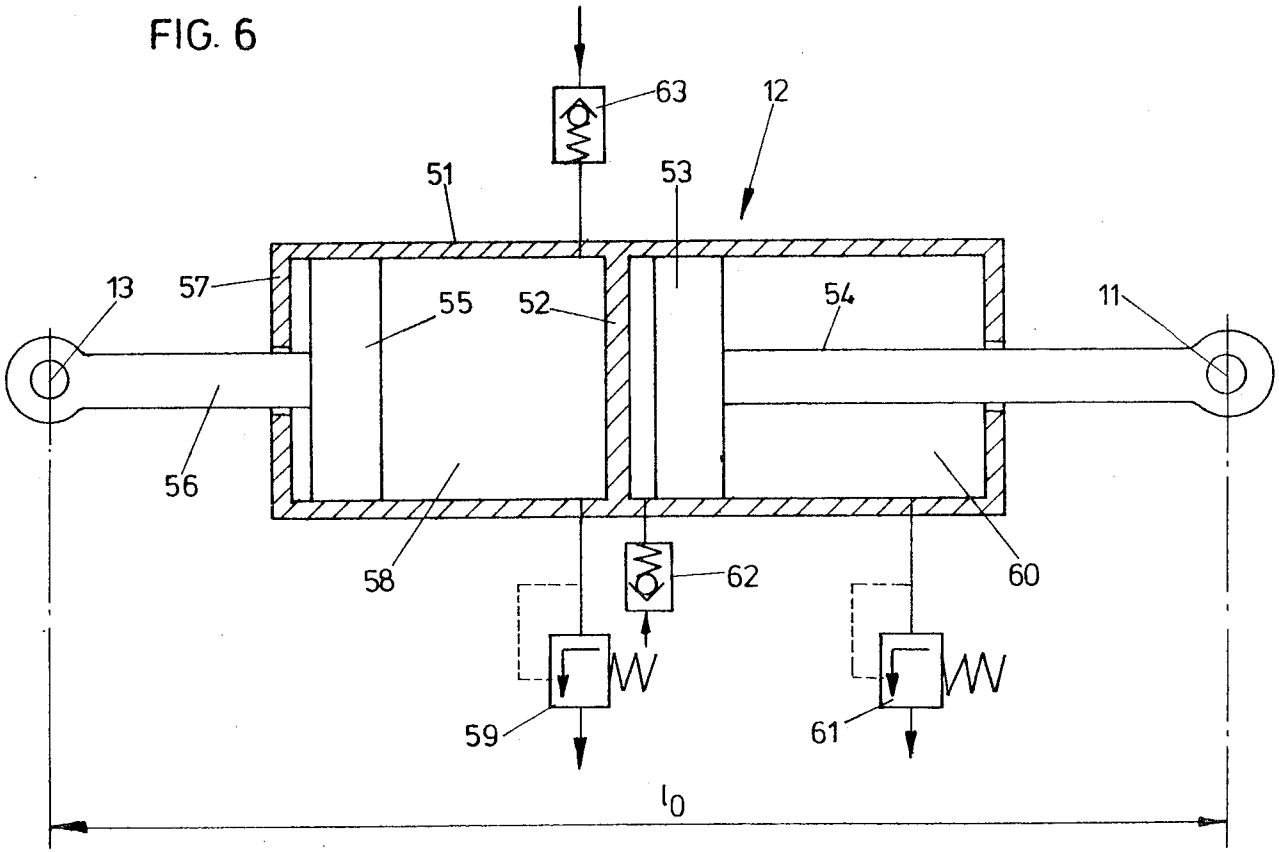

FIGS. 1, 2 and 3 supporting frame, FIG. 1 showing a side elevation, FIG. 2 showing a plan view and FIG. 3 showing an other side elevation. FIGS. 4, 5 and 6 illustrate various embodiments of the directing strut.

The base frame 1 is movable on caterpillars 2. The cap 5 is supported on the base frame by four hydraulic props 3 arranged on the corners of a rectangle and by a lemniscate drive means 4. The props 3 are supported on the base frame 1 by means of spherical joints 6 and are supported on the cap 5 by means of spherical joints 7 and are thus universally swivellable out from their vertical position shown. On account of these props 3 being vertically arranged, any horizontal shifting movement of the cap 5, which shifting movement might occur in case of a shifting movement of the mine roof, does not or only to a neglectible extent change the vertical distance of the cap 5 from the base frame. The props 3 are, in accordance with usual practice, equipped with an over-load valve or rock burst valve not shown.

The lemniscate drive means has an upper lemniscate guide 8 and a lower lemniscate guide 9 which are connected one with the other by a pivotal joint 10, A directing strut 12 formed of a piston-cylinder-aggregate is pivotably linked to the upper lemniscate guide 8 at 11. The other end of this directing strut 12 is linked to a linking point 13 connected with the base frame 1. The upper lemniscate guide is connected to the cap 5 by means of a universal joint 14 for being universally swivellable.

A swivel frame 20 formed of struts 15, 16, 17, 18 and 19 is connected to the base frame for being swivelable around an axis 21 in a direction transversally extending relative to the plane defined by the lemniscate guides 8 and 9. The lemniscate guides 8 and 9 are broad in shape and thus laterally stiff, and the swivel frame 20 is equally designed for being laterally stiff. The linking point 10 is formed of a double joint and thus equally stiff. Also the lemniscate guide 9 is connected with the swivel frame 20 by means of a double joint 22. The whole lemniscate drive means 4 forms together with the swivel frame 20 a unit which is laterally stiff in a direction transversally extending relative to the plane defined by the lemniscate guides 8, 9. This unit is supported by piston-cylinder-aggregates 23 and 24 pivotally connected to the swivel frame 20 at 25 and to the base frame 1 at 26 and this in a direction transversally extending relative to the plane defined by the lemniscate guides. These piston-cylinder-aggregates 23 and 24 are equipped with over-load valves, so that the lemniscate drive means 4 can, together with the swivel frame 20 limitedly yield any over-load acting in a direction transversally extending relative to the plane defined by the lemniscate guides 8, 9. The piston-cylinder-aggregates 23, 24 are additionally equipped with supply means (equally not shown) for pressurizing fluid and comprising arbitrarily actuable valves, so that the lemniscate drive means 4 can, in case of an inclined mine floor, be brought together with the swivel frame 20 into an oblique position relative to the base frame 1.

In the drawing, the supporting frame is shown in its uppermost extended position. Within a working range a, the cap can be lowered into the position 5' shown in dashed lines. Within this working range a, the length of the directing strut 12 shall remain unchanged for providing the possibility to move the cap in vertical direction via the lemniscate drive means 4. Furthermore, the cap 5 can be lowered into a transport position 5″, the prop 3 thereby arriving the position 3″ and the lemniscate guides 8 and 9 arriving the positions 8″ and 9″. The directing strut 12 thereby arrives the position 12″, whereby the piston rod 27 is extended to the position 27″.

Within the operating range a, the directing rod 12 designed as a piston-cylinder-aggregate shall maintain unchanged one and the same length b. FIGS. 4, 5 and 6 show various embodiments serving this purpose.

FIG. 4 shows an embodiment, with which a piston 29 is, together with its piston rod 30, guided within the cylinder 28 of the piston-cylinder-aggregate forming the directing strut 12. Both linking points are again designated by 11 and 13. The left-hand working chamber 31 is connected with the working chamber 32 of a measuring cylinder 33. The working chamber 32 is limited by a piston 34. The extreme left-hand position of the piston 29 is designated by 29′. The volume capacity of the working chamber 32 corresponds—in right-hand position of the piston 34—to the displacement volume within the working chamber 31 to be observed if the piston is moved from its position 29 shown in full lines into the position 29′ shown in dashed lines. When shifting the piston in its extreme left-hand position, the working chamber 31 is filled via the conduit 35 and the piston is moved from its position 29′ shown in dashed lines into the position 29. In this mean position, the piston 29 encloses a certain volume of pressurized fluid within the working chamber 31 and a certain volume of pressurized fluid within the working chamber 36. In this mean position, the distance between the linking points 11 and 13 is $l_o$. In this position $l_o$, the piston 29 is located within the operating range a. An overload valve 37 is connected with the working chamber 31 and an overload valve 38 is connected with the working chamber 36. In case of any overload acting in the one or in the other direction, pressurized fluid is pressed back into the container not shown via the overload valve 37 or 38, while pressurized fluid is sucked into the other working chamber via a check valve 39 or 40, respectively, into the respective other working chamber. If the cap 5 shall be brought into the transport position 5″, the overload valve 38 is opened, noting that pressurized fluid flows from the working chamber 36 back into the container and pressurized fluid is supplied to the working chamber 31 via the check valve 40, so that the length $l_o$ is increased to its maximum extended length. In the arrangement according to FIG. 5, the piston 41 assumes the mean position in which the linking points 13 and 11 have again the distance $l_o$ one from the other. The working chamber 31 and 36 are located at either sides of the piston 41. The position of the piston is determined by a transmitter 42 provided on the piston rod 30 and by a sensor 43. A pump 44 supplies pressurized fluid to the working chamber 36 via a conduit 45 and a check valve 46. The pump 44 is actuated by a control unit 47 until the sensor 43 indicates the correct position of the piston. Pressurized fluid can emerge from the working chamber 31 via the opened overload valve 48. Subsequently, overload valve 48 is closed and thus only acts now as an overload valve. Equally, an overload valve 49 is connected to the working chamber 36. In case of any occurring overload, the piston can now yield in right-hand direction or left-hand direction within the operating range a, noting that pressurized fluid may enter into the respective other working chamber via a check valve 50 or 46, respectively. If the cap 5 shall be brought into the transport position 5″, pressurized fluid is supplied into the working chamber 31 via the check valve 50.

In the embodiment according to FIG. 6, the cylinder 51 is subdivided by an intermediate wall 52. In the position $l_o$, a piston 53 connected with the linking point 11 via a piston rod 54 contacts the intermediate wall 52. A second piston 55 is connected with the linking point 13 via a piston rod 56 and engages the front wall 57 of the cylinder 51. The piston rod 56 is untightly passed through the cylinder wall 57. If now an overload acts in the sense of reducing the distance $l_o$, the piston 55 is pressed into the working chamber 58 and pressurized fluid is expelled via an overload valve 59. If an overload acts in the sense of increasing the distance $l_o$, the piston 53 is pulled into the working chamber 60 and pressurized fluid is expelled via an overload valve 61, noting that pressurized fluid is allowed to enter the space between the intermediate wall 52 and the piston 53 via a check valve 26. If the cap shall be lowered into the transport position 5″, pressurized fluid is supplied via the check valve 62 into the space between the intermediate wall 52 and the piston 53, so that the piston rod 54 is completely shifted in outward direction. A check valve 63 opening in direction to the working space 58 is connected to this working space and serves the purpose of introducing pressurized fluid for moving the piston 55 into its left-hand end position.

What is claimed is:

1. A movable supporting frame for supporting the roof in underground cavities comprising a base frame, roof cap disposed above said base frame, hydraulic props supporting said roof cap from said base frame and universally pivotally connected at their ends to said roof cap and said base frame, the props being swingable between vertical positions and inclined positions relative to the base frame such that the roof cap is vertically movable within a working area between a raised operating position and a lower operating position upon extension and retraction, respectively, of the props when in their vertical positions and such that the roof cap is also movable to a transport position located below said lower operating position upon swinging of the props in their retracted positions a leminiscate guide including an upper guide arm pivoted at one end to one end of a lower guide arm, means connecting the opposite end of the lower guide arm to the base frame for swivelling movement in transverse direction relative to the plane defined by the upper and lower guide arms, means connecting the opposite end of the upper guide arm to the roof cap for universal movement, a telescopic strut having one end pivoted to the upper guide arm at a location intermediate the ends of the upper guide arm and having an opposite end pivoted to a linking point connected with the base frame, the arrangement being such that the length of the strut remains unchanged during movement of the roof cap between its rasied operating position and its lower operating position and such that the length of the strut increases when the roof cap moves to its transport position.

2. A supporting frame as in claim 1 wherein said strut is a hydraulic piston and cylinder unit having two working chambers, one of which surrounds a piston rod and the ohter of which is on the opposite side of the piston from the piston rod, the hydraulic unit being maintained in a predetermined means length position within the working area of the roof cap by means of pressurized fluid contained in the working chambers, both working chambers having overload valves associated therewith, the hydraulic unit being extendible for attaining the transport position of the roof cap.

3. A supporting frame as in claim 2 wherein the working chamber of the hydraulic strut unit which is located opposite the piston rod, is connected with a working chamber in a measuring piston and cylinder unit.

4. A supporting frame as in claim 3 wherein the total volumetric capacity of the measuring cylinder is equal to the volume of said other working chamber of the hydraulic strut unit and this in the predetermined mean adjusted length position of the cylinder-piston-aggregate.

5. A supporting frame as in claim 1 wherein the lemniscate guide is laterally stiff in the direction transversally extending relative to the plane of the lemniscate guide arms, and wherein the lemniscate guide is supported at both sides by piston and cylinder units in a direction transversally extending relative to the plane defined by the lemniscate guide arms, these units having working chambers which can be supplied with pressurizing fluid and which are provided with overload valves.

6. A supporting frame as in claim 1 including a swivel frame having linked thereto the lower lemniscate guide arm and the hydraulic strut is linked to the base frame for swivelling movement in transverse direction relative to the plane defined by the lemniscate guide arms, the swivel frame and the lemnsicate guide arms being connected one with the other for being laterally stiff in transverse direction relative to the plane of the lemniscate guide arms, the supporting frame also including hydraulic piston and cylinder units which act on the swivel frame in transverse direction relative to the plane defined by the lemniscate guide arms.

7. A supporting frame as in claim 1 wherein the base frame is movable on a caterpillar crawler chassis and has a drive means for the caterpillars.

8. A supporting frame as in claim 7 including a remote control for the drive means of the caterpillars.

* * * * *